United States Patent [19]

Ohkubo et al.

[11] Patent Number: 4,719,489

[45] Date of Patent: Jan. 12, 1988

[54] RECORDING APPARATUS HAVING MATERIAL FEED MODE DEPENDENT FIXING CONTROL

[75] Inventors: Masaharu Ohkubo; Yasumasa Ohtsuka; Jun Asai, all of Yokohama; Yoshihiro Murasawa, Kawasaki, all of Japan

[73] Assignee: Canon Kabushiki Kaisha, Tokyo, Japan

[21] Appl. No.: 62,430

[22] Filed: Jun. 16, 1987

Related U.S. Application Data

[63] Continuation of Ser. No. 695,807, Jan. 28, 1985, abandoned.

[30] Foreign Application Priority Data

| | | | |
|---|---|---|---|
| Feb. 3, 1984 | [JP] | Japan | 60-17946 |
| Feb. 14, 1984 | [JP] | Japan | 60-26285 |
| Feb. 21, 1984 | [JP] | Japan | 60-31797 |

[51] Int. Cl.[4] ..... G03G 15/00

[52] U.S. Cl. ..... 355/3 FU; 355/3 SH; 355/14 FU; 355/14 SH; 219/216

[58] Field of Search ..... 355/3 FU, 3 SH, 14 FU, 355/14 SH, 24; 219/216

[56] References Cited

U.S. PATENT DOCUMENTS

| | | | |
|---|---|---|---|
| 4,349,269 | 9/1982 | Okada | 355/3 FU X |
| 4,373,801 | 2/1983 | Itoh | 355/3 FU X |
| 4,468,113 | 8/1984 | Motohashi et al. | 355/3 SH X |
| 4,549,803 | 10/1985 | Ohno et al. | 355/14 FU |

*Primary Examiner*—A. C. Prescott

*Attorney, Agent, or Firm*—Fitzpatrick, Cella, Harper & Scinto

[57] ABSTRACT

A recording apparatus includes a fixing device for fixing an image to be recorded, on a recording material selectively under a first fixing condition or a second fixing condition; a feeder for feeding the recording material to said fixing means selectively in a first recording material feed mode or a second recording material feed mode which is different from said first recording material feed mode; and a controller, responsive to the change of the recording material feed modes, for bringing said fixing means under the first fixing condition upon the first recording material feeding mode and to a second fixing condition, which is different from the first fixing condition, upon the second recording material feed mode.

16 Claims, 16 Drawing Figures

RECORDING APPARATUS HAVING MATERIAL FEED MODE DEPENDENT FIXING CONTROL

This application is a continuation of application Ser. No. 695,807 filed Jan. 28, 1985, now abandoned.

BACKGROUND OF THE INVENTION

The present invention relates to a recording apparatus, such as a copying machine or a printer, for recording information. More particularly, it relates to a control of an image fixing condition or power in a recording apparatus having a plurality of recording material feeding modes.

A copying apparatus or printer has been made plactic-able wherein an image can be formed on various types of recording materials. As for such recording materials, a resin sheet and thick paper as well as letter paper and regular sheets are ordinarily used. It is important to effect the fixing operation on any of those recording materials in a stable and uniform manner. Therefore, in order to meet all of those materials, it is usual to set the fixing power or condition (the pressure and the temperature in heat-fixing; and the pressure or the speed of transportation in pressure-fixing) to the maximum.

However, under such a severe fixing conditions to meet the wide range of the recording materials, a printer which is often kept in the standby state for a long time, involves a serious problem, for example, rollers are deformed because of the high pressure and the temperature rise in the fixing device. This can result in the necessity of exchanging expensive parts or rollers, long before the service life determined solely by the ordinary use thereof is reached. In addition, in order to effect the image fixing on a usual recording material (having the thickness of several microns—200 microns, that is, relatively thin) in a stable and satisfactory manner, the fixing conditions require the high temperature and pressure, but those conditions create curl, if a sheet of paper having not more than 80 g weight is used. Furthermore, if a transmitted-light detecting means or a paper thickness detecting means is used for the purpose of distinguishing the recording material having the thickness of several microns—200 microns and the thick recording materials having the thickness more than 200 microns, erroneous detection can often occur, resulting in extraordinary toner off-set, curl, twining of the paper around the roller, paper jamming and so on. The detecting means used for those purposes are usually not durable in long time use, since malfunction can easily occur if paper dust or toner particles are attached thereto. For those reasons, they are expensive and not practical.

SUMMARY OF THE INVENTION

Accordingly, it is a principal object of the present invention to provide an apparatus having a higher durability, requiring less frequent exchange of the parts and providing a proper fixing operation.

It is another object of the present invention to provide an apparatus having heat-fixing means wherein the energy consumption is reduced, and the possible temperature rise in the apparatus is prevented, and which apparatus has a longer service life.

It is a further object of the present invention to provide an apparatus wherein the parts used with the apparatus (for example, a roller, a separation pawl, oil, a photosensitive member) receive a low load, and simultaneously the quality of the fixing operation is increased irrespective of the types of the paper used.

The present invention is based on the finding that the types of the recording material used in the apparatus are different in the manner and/or amount of the recording material feed, in dependence upon the paper feeding mode selected. In the present invention, therefore, the fixing conditions are changed depending on the selection of the paper feed modes.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 9B and 9C, with the manual feed mode.

DESCRIPTION OF THE PREFERRED EMBODIMENTS

Figure 1:
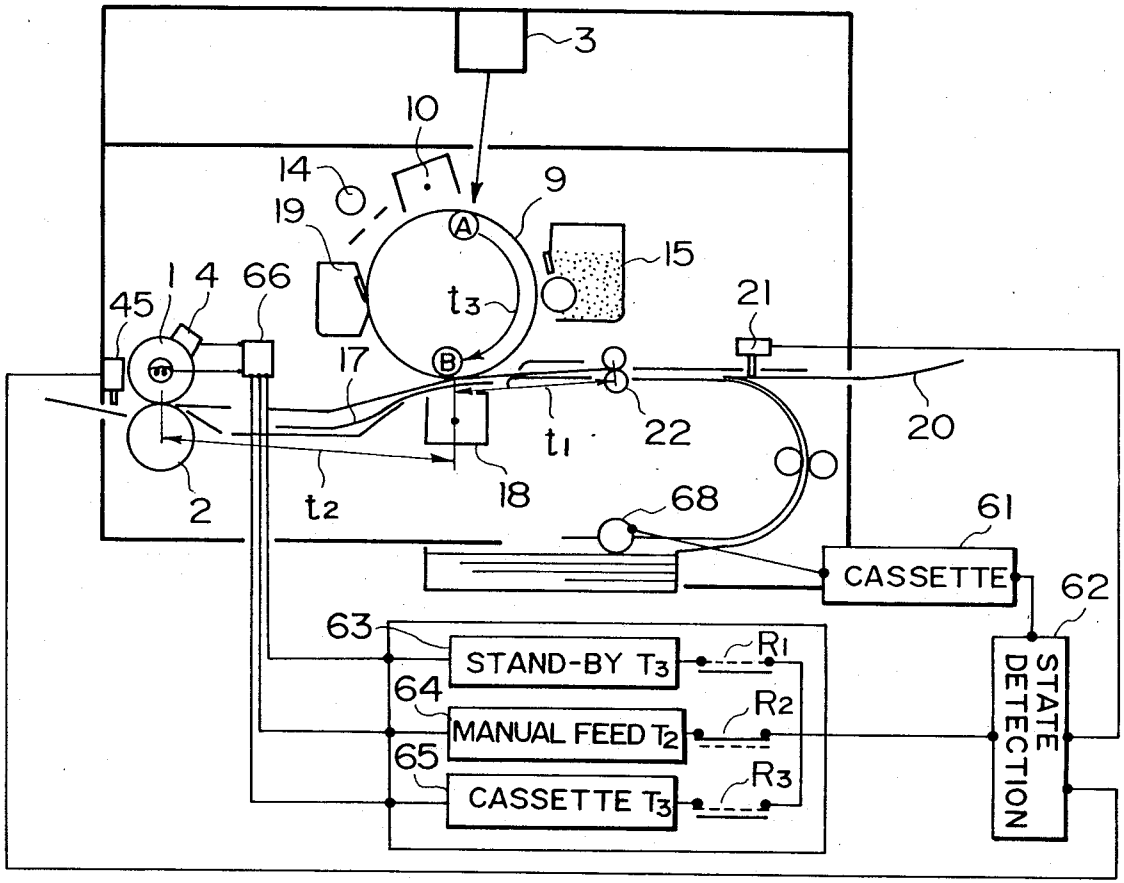
FIG. 1 is a somewhat schematic cross-sectional view of the general arrangement of the printer according to an embodiment of the present invention.

Referring to FIG. 1, there is shown a recording apparatus according to an embodiment of the present invention, which is shown as a laser beam printer, to which FIGS. 2–12 are related.

In this embodiment, an electrophotographic type laser beam printer is taken as an example of the recording apparatus according to the present invention.

The laser beam printer includes a photosensitive drum 9 having a metal cylinder, on which a photosensitive layer is formed. The photosensitive drum 9 is uniformly charged in the negative polarity by a primary charger 10, and then exposed to image light by image exposure means 3, such as LED, laser or the like. By this, a difference in the surface potential on the photosensitive drum 9 results in accordance with the dark-light pattern on the light image, so that a high contrast electrostatic latent image is formed. Thereafter, the latent image is developed with toner which has been negatively charged by the friction with a developing sleeve in a developing device. As for the developing process, such method or device as disclosed in Laid-Open Patent Application, Laid-Open No. 18656/1980, 18657/1980, 18678/1980 or 18679/1980 is usable.

A recording material 17, such as paper, is fed from a cassette 16 in a cassette mode or from a manual feed tray 20 in a manual feed mode. The recording material 17 receives positive charge from a transfer charger 18 at the backside thereof. The electrostatic attracting force provided by the positive charge is effective to transfer the visualized image from the photosensitive drum 9 to the recording material 17. The toner image, thus transfereed to the recording material, is heat-fixed by rollers 1 and 2 which are placed under the conditions which will be described in detail hereinafter.

The photosensitive drum 9, after the image is transferred therefrom is cleaned, by blade cleaning means 19 so that the photosensitive drum 9 is prepared for the next image formation.

When a recording material, such as a thick sheet of paper, a label sheet, OHP paper, which are used arbitrarily by the user is inserted from the outside of the apparatus by the manual feed tray 20, a manual feed sensor 21, disposed in the path for the manual feed, detects the recording material manually fed and detects.that the operation is to be in the manual feed mode and displays it. A registration roller 22 is effective to temporarily stop the recording material for a period of time which is predetermined in dependence on the mode selected, in the manner that the recording material is brought, toward the transfer charger 18, into registration with the toner image on the photosensitive drum 9. It is added here that an image fixing condition (at least one of the image fixing speed, the image fixing pressure and the image fixing temperature) is set to provide a better image fixing capability (hereinafter also called "high image fixing power") which is higher than in the cassette feed mode. The exchange of the fixing condition depending on the mode selection will be described in detail hereinafter. In the Figure, designated Ⓐ by is the image exposure position, and the reference Ⓑ designates the image transfer position.

As shown in FIG. 1, the passage for the recording material manually fed (to the tray 20) is substantially linear, while the passage for the recording material fed from the cassette is curved. This arrangement is advantageous from the standpoint of meeting the wide range of the recording materials. This is because the cassette contains ordinary sheets of paper, which can be conveyed along a curved passage without trouble, but it is difficult to transport thick sheets or OHP sheets, which will usually be manually fed to the tray 20, along a curved passage without trouble. It is, therefore, preferable to transport them along a substantially straight passage.

Figure 2:
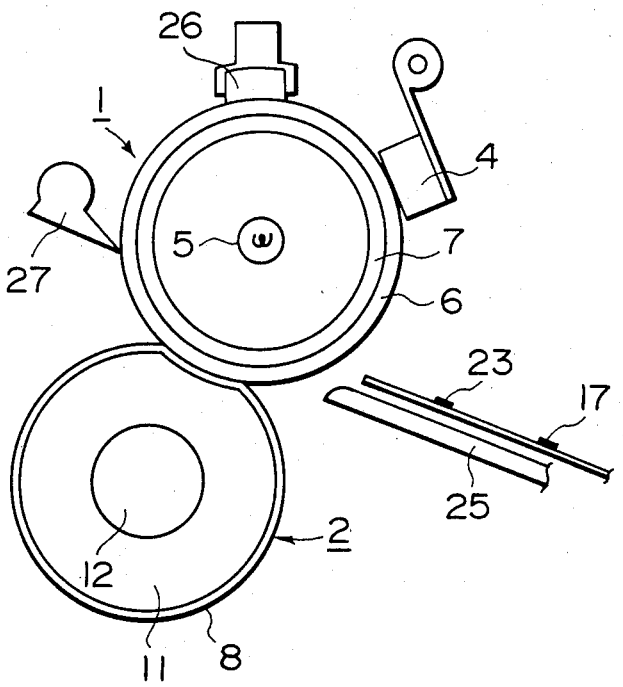
FIG. 2 is a more detailed cross-sectional view of an image fixing apparatus used with the printer shown in FIG. 1.

Referring now to FIG. 2 which shows the image fixing device in FIG. 1 in a larger scale, the image fixing roller 1 includes a core member 7 coated with a Teflon (Trade Mark) layer 6, within which core member a heater 5 is contained. The pressure roller 2 includes a core member 12 covered by a resilient and heat-resistant sponge rubber 11, which is covered by silicon rubber 8 having a high parting property. A temperature sensor 4 is provided to detect the surface temperature of the fixing roller 1 to control the heater 5. The temperature sensor 4 is, for example, a thermistor.

Figure 3:
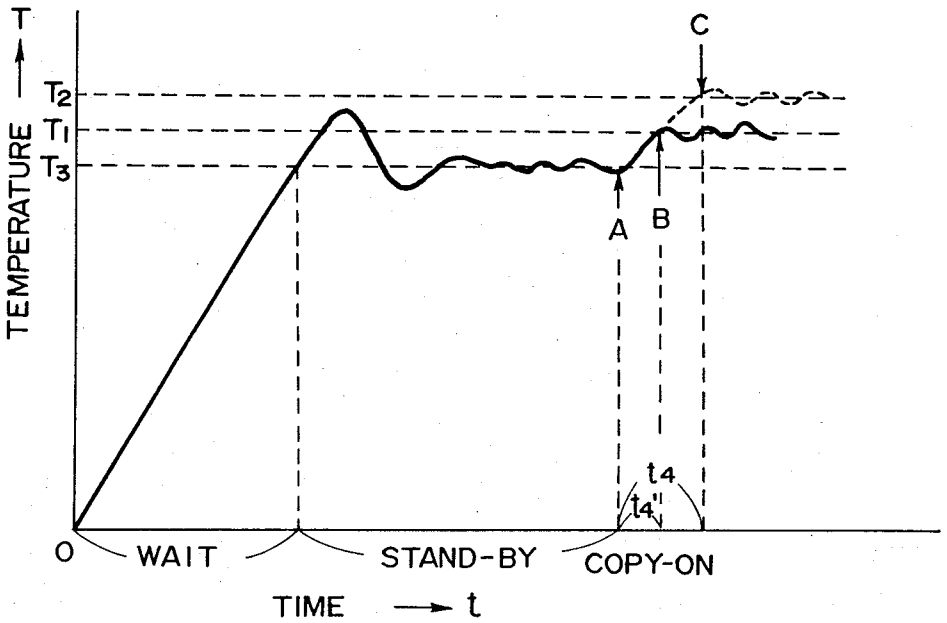
FIG. 3 is a graph showing the change in the surface temperature of a fixing roller of the fixing apparatus shown in FIG. 2.

FIG. 3 illustrates an example of the control for the above-described structure. The fixing roller 1, upon the main switch of the apparatus being turned on, is heated by the energization of the heater 5. The heater 5 is rendered repeatedly on and off with repeated overshooting until the surface temperature becomes T3. When the surface temperature of the fixing roller 1 becomes T3, the apparatus changes from the wait state to a stand-by state. When the apparatus receives a printing signal at the time designated by the reference A, the set temperature of the fixing device is changed to a temperature T1, which is higher than the temperature T3 for the purpose of the fixing operation in the cassette mode. With this change, the heater 5 is turned on to increase the surface temperature of the fixing roller 1 until it reaches the temperature T1, at the time designated by the reference B. Thereafter, the surface temperature of the image fixing roller 1 is kept around the same temperature. The time period between the print-on signal from the time T1, namely, the time period t'4 from the time A to the time B is preferably the same as or smaller than the time required for the leading edge of the recording material 17 to reach the fixing device. In other words, it is preferable that the surface temperature of the fixing roller 1 approaches to the set temperature T1 or has reached the same prior to the leading edge of the recording material reach to the image fixing device.

Upon the manual feed mode, the recording material is detected by the sensor at the manual feed inlet, the temperature of the fixing device is set to T2 which is higher than the temperture in the cassette feed mode. The heater 5 is energized until the surface temperature of the fixing roller 1 reaches T2, at the point C as shown. The time period from the time when the sensor detects the recording material manually fed and changes the operation mode from the cassette feed mode to the manual feed mode (that is, the point of time A) to the time when the surface temperature of the fixing roller 1 reaches T2, namely, the time period t4 from the point of time A to the point of time C, is longer than in the cassette feed mode, because the time period T1 is shorter than the time period T2. In the manual feed mode, therefore, it is preferable that the time period required for the fixing roller 1 temperature to become substantially T2, is equal to or smaller than the time period from the sensor detecting the recording material manually fed to the recording material reaching the fixing device. For this reason, if the electric power which can be consumed for the heater 5 is sufficient, the power supplied to the heater 5 is increased so as to reduce the time required for the temperature to rise from T3 to T2. If, on the other hand, the electric power is not enough, and therefore the power supply can not be increased, it is preferable that the recording material is delayed. For this purpose, the time required from the detection of the recording material by the sensor 21 to the actual start of the printing operation is increased, or the time spent for the pre-rotation is increased, so that the time required for the recording material to reach the fixing device is prolonged. The pre-rotation is the rotation of the photosensitive drum 9 to prepare it for the actual image formation, prior to the start of the actual image forming operation on the photosensitive drum 9.

In any way, the recording material 17 bearing thereon the unfixed toner image 23 is transported along the guiding member 25 to the fixing device, where it is heated by the two rollers 1 and 2, so that the toner thereon is fixed on the recording material 7. The recording material 17 is separated from the surface of the roller by the separation pawl 27 and then discharged. The toner which has been deposited onto the surface of the fixing roller 1 is cleaned off by the felt 26. The felt 26 contains a parting agent, such as silicon oil, and therefore, it is effective also to apply the parting agent onto the surface of the fixing roller 1.

Referring back to FIG. 1, the description will be made with respect to the mechanism for increasing the image fixing power by the temperature change. In the system shown in FIG. 1, the mode of the recording material feed is detected by the sensors 21 and 61 for detecting the actually used passage of the recording material; then, the image fixing operation is effected with the temperature setting for the selected or detected mode; and upon the termination of the mode operation, the set temperature is automatically reset. In this example, when the manual feed mode detection sensor 21 detects the recording material, that is, when the manual feed mode is selected, a state detection means 62 transmits a signal to a temperature changing means 67. A relay R1 and a relay R2 are rendered off and on, respectively. Because of this, the manual feed mode setting temperature T2 is selected in place of the stand-by temperature T3 which is lower than the manual feed mode setting temperature T2. In this manner, the temperature setting in the temperature control means 66 for the fixing roller 1 is changed to the temperature T2.

After the completion of the fixing operation to the recording material manually fed, discharged sheet detecting means 45 detects the recording material at the position adjacent to the outlet side of the fixing roller 1 and the pressure roller 2. Upon the detection of the termination of the operation in that mode by the state detecting means 62, the relay R3 and the relay R1 is rendered off and on respectively. More detailed example is shown in FIG. 6 (T2=180° C.).

When, on the other hand, the state detection means 62 detects the cassette feed mode by the cassette feed mode sensor 61 which detects the operations of the start switch manually operated by the user or the paper feeding roller 68 for the cassette, the relay R1 and the relay R3 are rendered off and on so that the cassette feed setting temperature T1 is set in the temperature control means 66, where T3<T1 <T2. When the recording material fed in the cassette feed mode is subjected to the image fixing process, the termination of the mode is detected by the state detecting means 62 and the discharged paper detecting means 45. Then, the relay R2 and the relay R1 are rendered off and on, respectively. The more detailed illustration is made in conjunction with FIG. 5 (T1=170 ° C.).

Figure 5:
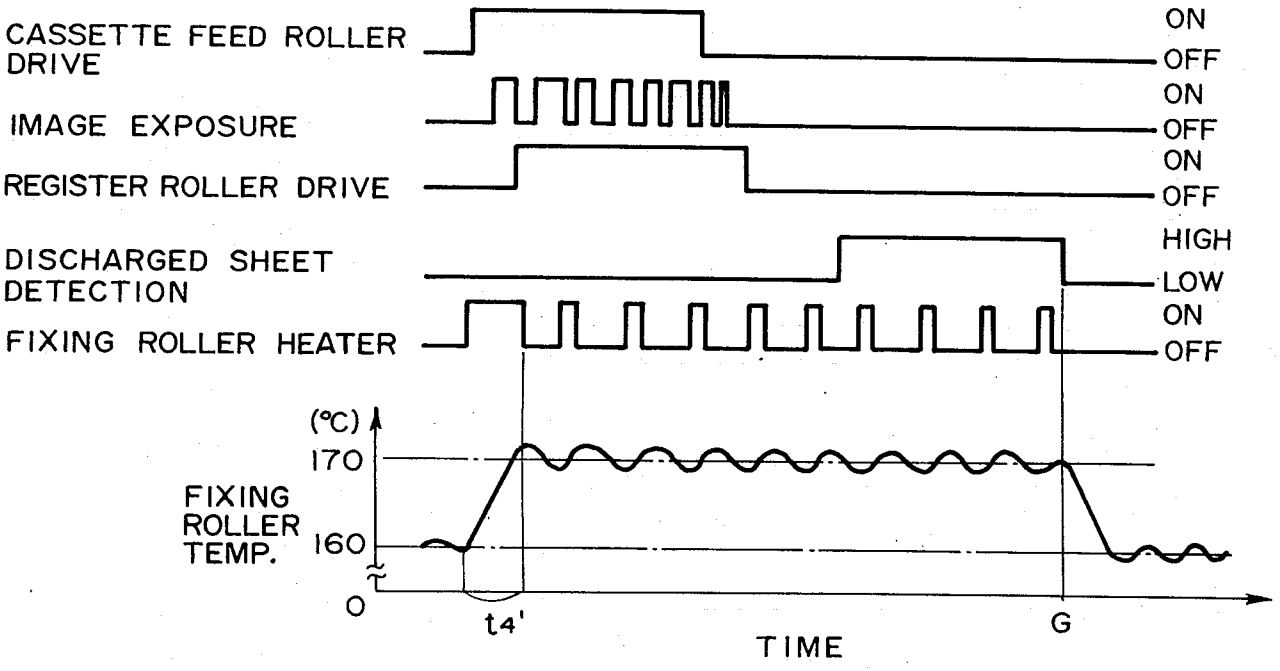
FIG. 5 is a timing chart and a graph of the temperature change in the apparatus of FIG. 1 when operated in a cassette mode.
Figure 6:
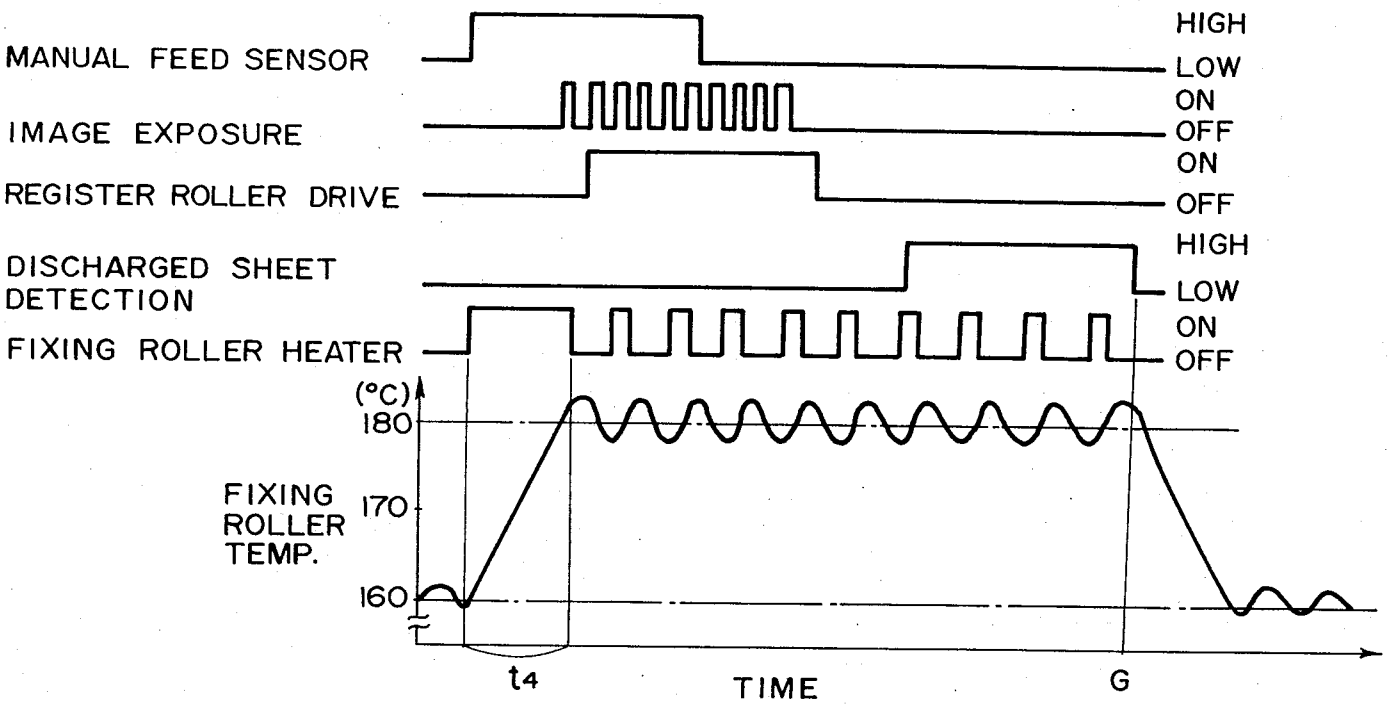
FIG. 6 is a timing chart and a graph of the temperature change in the apparatus of FIG. 1 when in a manual feed mode.

Referring now to FIGS. 5 and 6, the processing of one sheet in each of the cassette mode and the manual mode is illustrated with the timing charts and with the graph showing the temperature change. The operation timing of each part will be readily understood in those Figures. It should be noted that the timing of the image exposure operation and that of the registration roller 22 operation are different depending on the mode. After the temperature rise and the detection of the recording material trailing edge G, in each of the modes, the set temperature is immediately decreased to 160° C. which is the stand-by temperature T3, in this example. Thus, the foregoing embodiment is directed to a recording apparatus having at least two recording material feed modes, and after the image fixing process in the recording material feeding mode which requires a higher fixing power, the fixing device is reset to the lower image fixing power, so that the temperature rise in the apparatus or around the device can be avoided, or that the service life of the roller, the photosensitive member or the other parts in the apparatus is not decreased.

If the system is simply such that the paper feed mode is changed by the used recording material (manual feed or the like) or by the selection of the operator, the apparatus will frequently be kept under the high fixing power conditions. The apparatus according to the embodiment includes the resetting of the temperature so that the apparatus is not kept under the high power conditions, whereby it is not necessary to use limited and expensive materials for the various parts. This is effective to reduce the cost.

Figure 7:
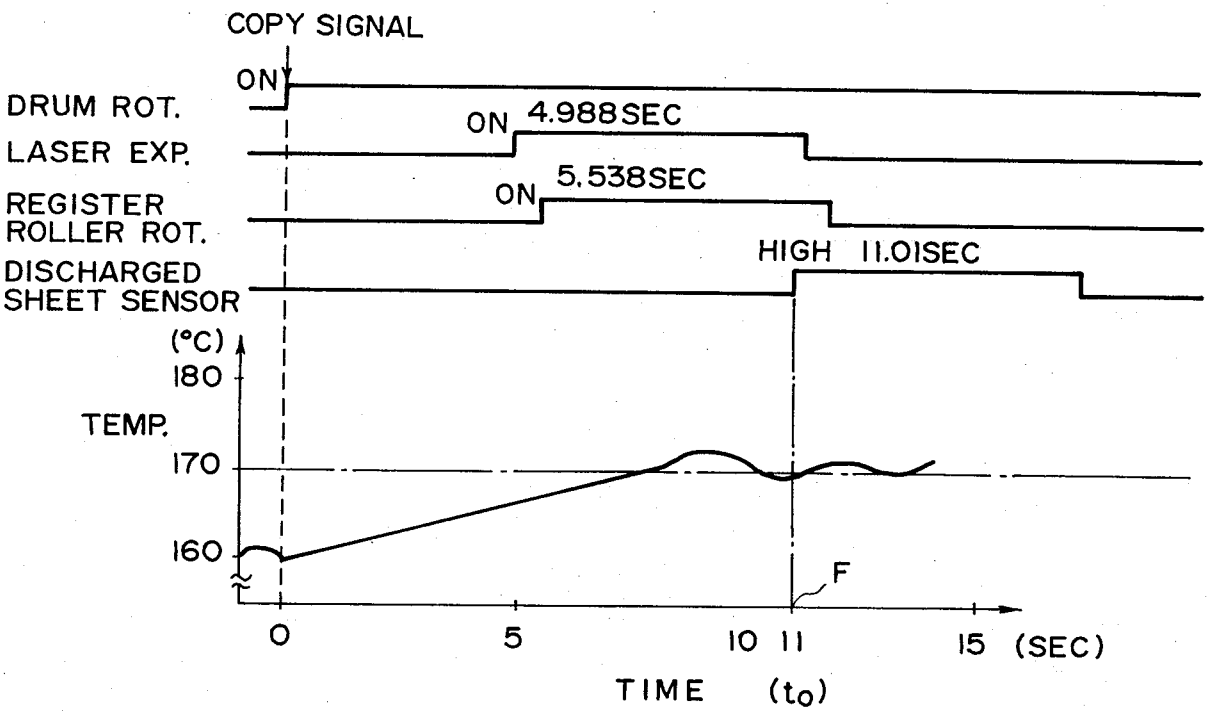
FIG. 7 shows more in detail a part of FIG. 5.
Figure 8:
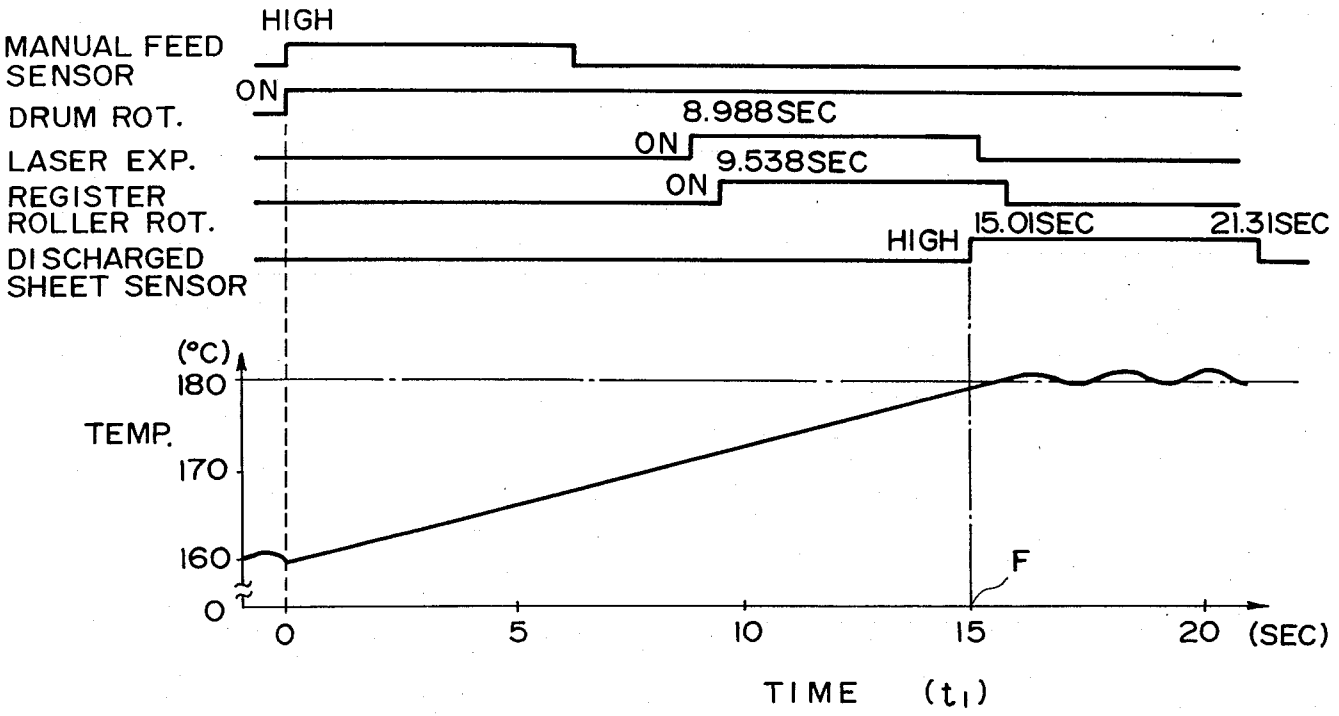
FIG. 8 shows more in detail a part of FIG. 6.

FIGS. 7 and 8 illustrate more detailed timing charts and the temperature changes in the respective modes.

As for the fixing roller 1 in the fixing device shown in FIG. 2, the use was made of an aluminum cylinder having the diameter of 25 mm and the thickness of 1.6 mm which was coated with 25 microns thickness of polytetrafluoroethylene layer. The pressure roller 2 was a stainless steel shaft having the diameter of 10 mm which was covered by Si sponge layer of 6 mm thickness, which, in turn, was coated by a surface layer consisting of a Si rubber layer of 1 mm thickness. The fixing roller had the length of 272 mm, and the rubber portion of the pressure roller was 230 mm. The fixing roller and the pressure roller were pressed to each other under the line pressure of 0.25 kg/cm. In the fixing roller 1, the heater 5 of 600 W was fixed. The stand-by temperature T3 was 150° C.; the cassette mode temperature T1, 160° C.; and the manual feed mode temperature T2, 180° C. With those parameters, the image fixing capability on a thick sheet of paper has been increased, and simultaneously the service life of the fixing device is increased.

The cassette mode temperature T1 is less than the conventional corresponding temperature which is about 180° C., by as large as 20° C., with the advantage of less temperature rise and the prevention of heat deterioration of the rollers. In addition, the overheating to the recording material fed from the cassette is reduced or completely eliminated, thus preventing the curling of the recording material so as to accomplish a desired image fixing. On the other hand, in a special mode, such as the manual feed mode, wherein the recording material is selected arbitrarily by the user, it is needed to meet a very wide range of the recording materials, without increasing the temperature for the cassette mode image fixing. In order to meet those dual purposes, it is usually desired that there is the temperature difference about 10°-30° C.

In the fixing device described above, the time required for the temperature rise under a low temperature condition, is such that 15.5 seconds from 160° C. (T3) to 180° C. (T2); and 8 seconds from 160° C. (T3) to 170° (T1). On the other hand, the time period required for the recording material from the register roller 21 to the actuation of the discharged paper detecting means 45 is 5.472 seconds. The time from the register roller 21 to the point F between the rollers 1 and 2 is 5.471 seconds. The time required from the start of the image exposure to the start of the registering roller 21 is 0.55 second, which is required to bring the recording material into alignment with the image on the photosensitive drum 9. In consideration of those time period, the timing of each of the operations are as shown in the Figures. Comparing FIG. 7 and FIG. 8, it will be understood that the paper feed timing in the manual feed mode is delayed for 4 seconds as compared with the cassette mode paper feed.

In this manner, the paper feeding is controlled in consideration of the time when the image fixing device reaches the desired temperature, thus preventing the possible initial unsatisfactory image fixing.

As another example of the recording material feed control, the speed of the recording material transport from the transfer charger 18 to the contact point between the fixing roller 1 and the pressing roller 2 is controlled. This alternative is effective when the distance between the transfer charger 18 to the contact point is long enough. The speed in this passage is decreased in the manual feed mode as compared with the cassette feed mode.

Because of this, the time from the printing start to the insertion of the paper to the fixing device is made longer in the manual feed mode, so as to make it easier to raise the temperature from T3 to T2.

In the foregoing embodiments, the relation between the stand-by temperature T3 and the cassette mode temperature T1 is such that T3<T1. This is the most preferable example, but the temperature T3 may be equal to the temperature T1.

According to the embodiments described above, the temperature of the fixing device is maintained low in the stand-by state and cassette feed mode, which are most frequently exists in usual operations, while the temperature is raised only when in the manual feed mode which is less frequently used, and allows the use of a wide range of recording materials so as to meet the variety of the recording materials. As a result, the roller deterioration and the temperature rise in the apparatus can be prevented with the fixing quality maintained good.

Figure 4:
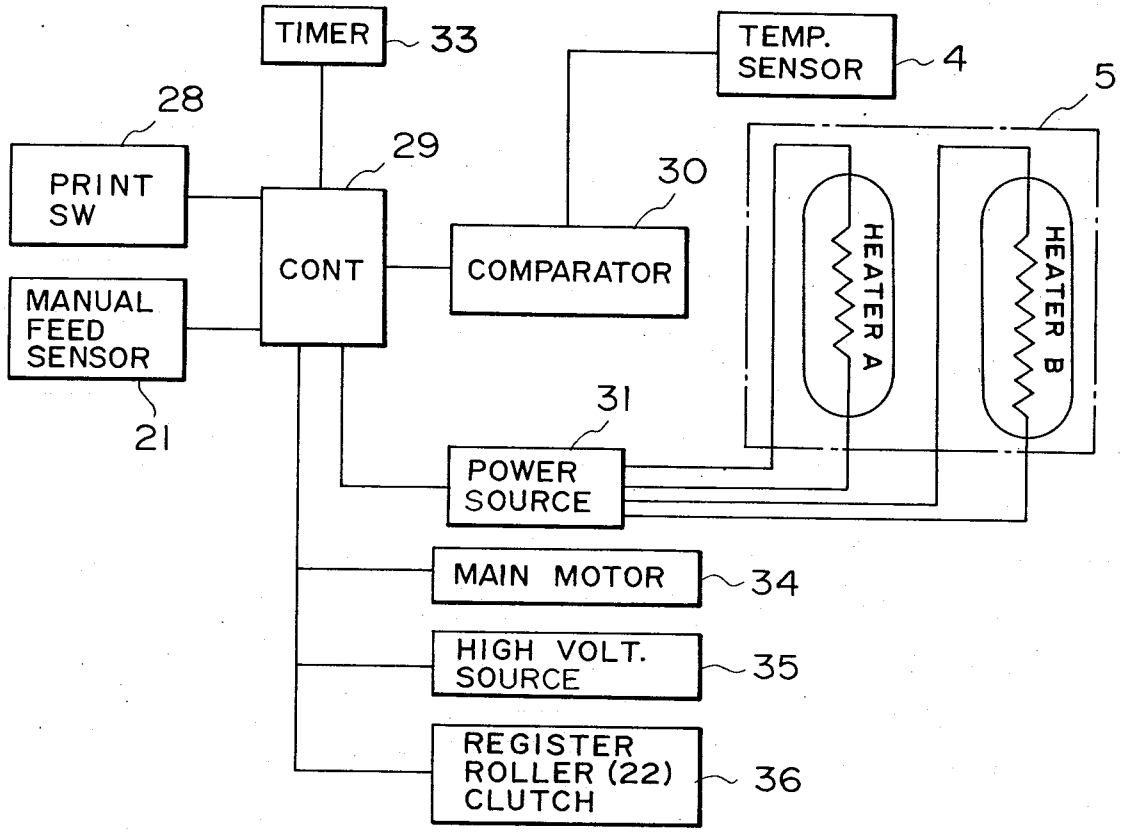
FIG. 4 is a block diagram of a control of the image fixing apparatus shown in FIG. 2.

In the foregoing embodiments, the heater 5 is used to heat the fixing roller 1. FIG. 4 shows the block diagram for the control of such a structure. The heater 5 is shown as having heater element A and another heater element B, that is, the heater 5 includes a plurality of heater elements. The control of this example is as follows. During the stand-by state, only the smaller heater element having 400 W power is used. When in cassette feed mode, which requires to heat the fixing roller 1 to the cassette feed mode temperature T1, the smaller heater element is deenergized, and the larger heater element of 600 W is energized. When the manual feed mode is selected, which requires to heat the fixing roller 1 to the temperature T2, both of the heater elements are energized. In the construction shown in FIG. 4, when the printing switch 28 is depressed in the cassette feed mode which is the usual mode, the controller 29 switches the level of the comparator 30 from the level A for the stand-by temperature T3 to the level B for the cassette feed mode temperature T1 (T1>T3). When the manual feed mode is selected, the controller 29 switches the comparator 30 from the level A to level C for the manual feed temperature T2 in response to the signal produced by the manual feed sensor 21. The comparator 30 compares the level determined by the controller 29 and the output of the temperature sensor 4, and the result of the comparison is transmitted to the controller 29. The power source is controlled by the controller 29 to energize or deenergize the heater 5. The power source 31 initiates its operation when the controller 29 receives the signal from the print switch 28 or the manual feed sensor 21. Then, the power source 31 is on-off-controlled in response to the output of the comparator 30. The controller 29 also actuates the timer 33 upon the actuation of the print switch 28, and effect the on-off conrol of the high voltage source 35 used for the latent image formation, development and the image transfer; effects the start and stop of the main motor 34 for driving the photosensitive drum and the recording material; and the start and stop of the image exposure.

The heater elements A and B are contained in the image fixing roller 1 of FIG. 2, and the power thereof are 600 W and 400 W, respectively. Before the print switch 28 is actuated, that is, during the stand-by state, the surface temperature of the fixing roller 1 is maintained to be T3 by the on-off control of the heater B having the lower power. When the print switch is actuated, the operation is changed to the cassette feed mode with the result that the heater B is rendered off, and the heater A of larger power is energized in place thereof. After the surface temperature reaches the cassette feed mode temperature T1, the heater B of the lower power is again used to keep the temperature T1.

If the manual feed mode is selected, the system is changed to the manual feed mode in response to the output of the manual feed mode sensor 21. Then, both of the heaters A and B are energized to increase the surface temperature of the fixing roller 1 to the manual feed mode temperature T2. After the temperature is reached, only the heater B of the lower power is used to keep the temperature T2. Using the low power heater to keep a temperature is desirable from the stand point of reducing the magnitude of ripple of the temperature.

Figure 9A:
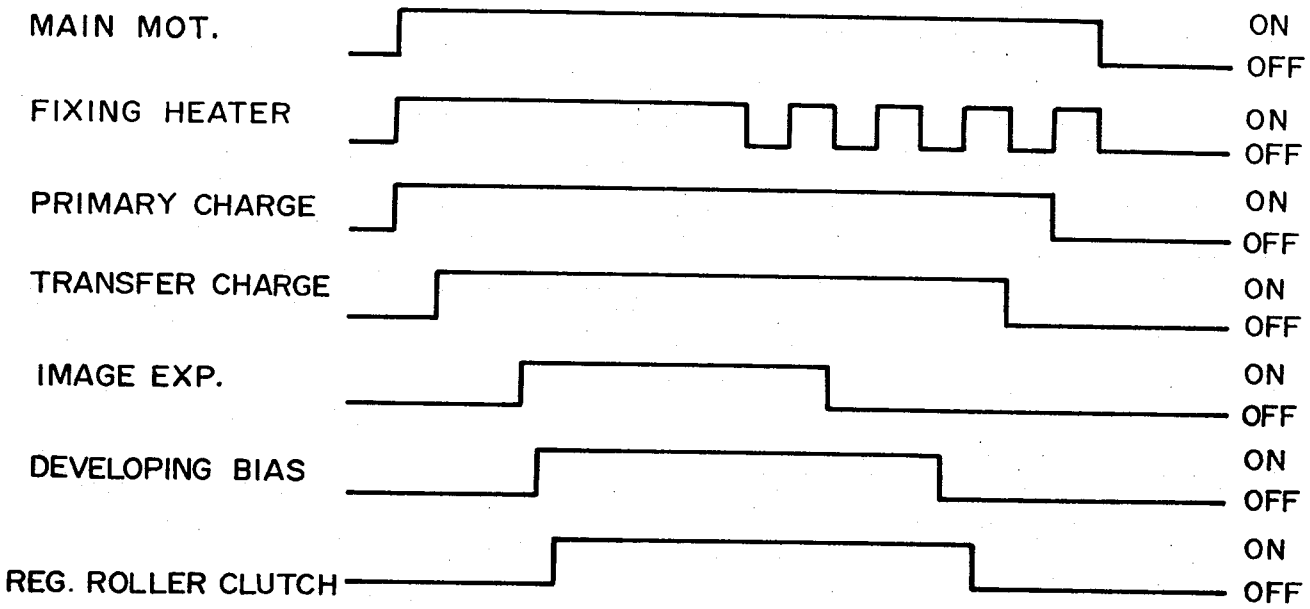
FIGS. 9A, 9B and 9C are timing charts in image fixing operations, wherein FIG. 9A deals with a cassette mode.

Upon termination of printing operation, the temperature is reset to T3 in either of the cassette feed mode and the manual feed mode, to restore the system to the stand-by state. By using two heaters having different power, the difference is reduced between the time t0 required for the temperature rise from T3 to T1 and the time t1 required for the temperature rise from T3 to T2. In this case, the timing control for the cassette feed mode as shown in FIG. 9A can cover both of the modes so as to make the control circuit simpler to reduce the cost.

In the cassette feed mode which is more frequently used, if the fixing roller 1 is heated to the temperature T1 by 600 W plus 400 W heater means, the amount of overshoot is increased, resulting in shorter service life of the roller. In this embodiment, however, the heating is performed by the 600 W heater so that the amount of overshoot is decreased as compared with using the 1000 W heater means. This is effective to greatly increase the service life of the roller.

In the foregoing embodiment, two heaters are used, but more heater may be used. As another example, a heater having the power of 1200 W is used, with the input power being variable depending on the mode selected. In this case, it is desirable that the power supplied to the heater is such that W1<W2<W3, where W1 is the power supplied to the heater in the stand-by state; W2 is the power in the cassette feed mode; and W3 is the power in the manual feed mode.

Figure 9B:
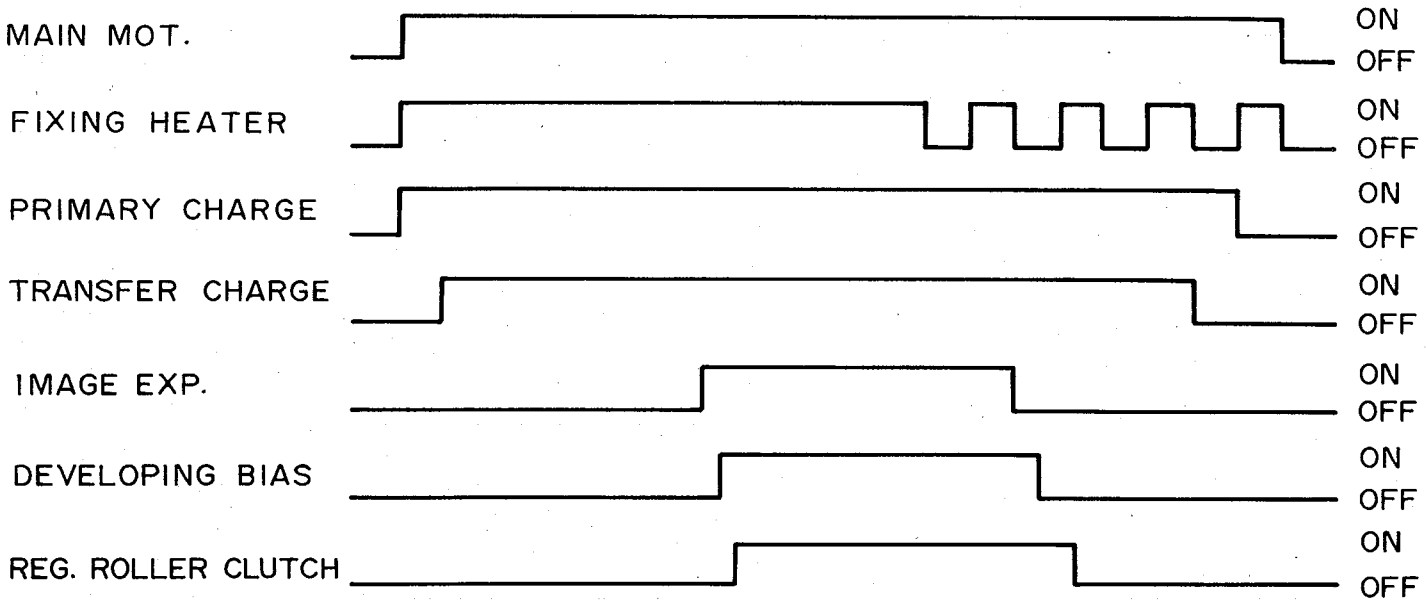
Figure 9C:
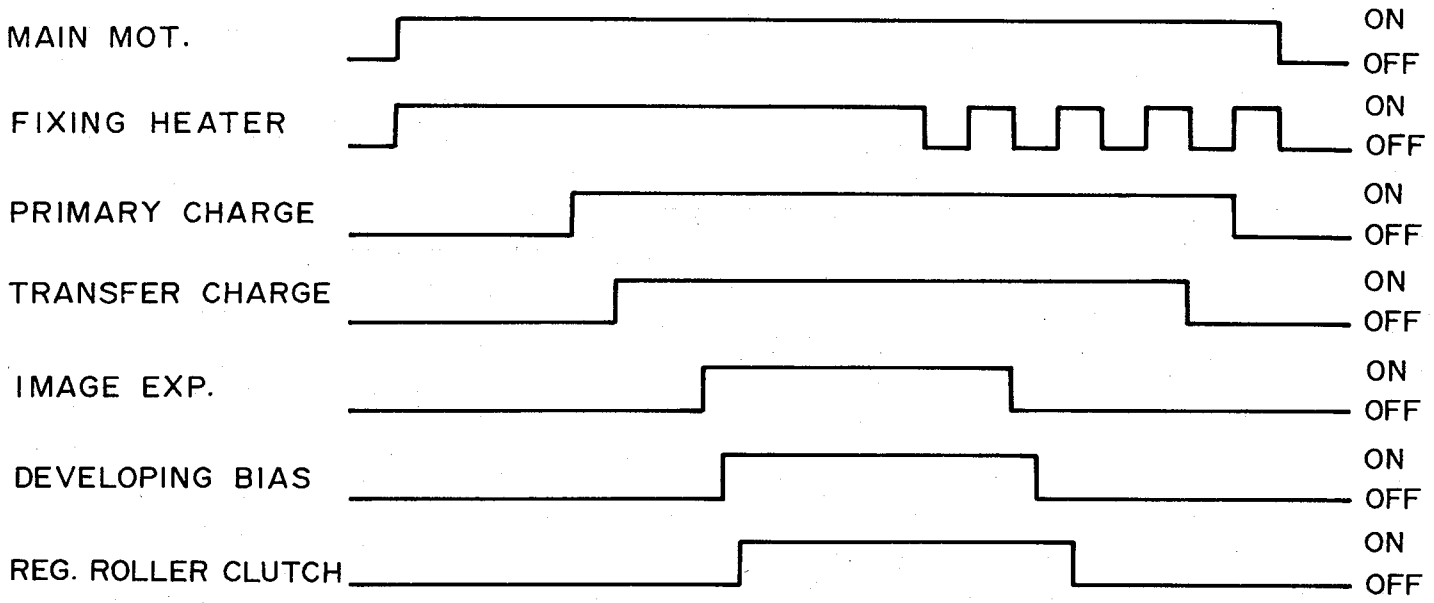

In this embodiment, the control of the time when the recording material reaches the fixing device is made by prolonging the pre-rotation time period. FIG. 9 shows the timing chart both for the cassette feed mode and the manual feed mode. As will be understood in FIGS. 9A and 9B, the image exposure, the actuation of the developing bias and the actuation of the registration roller clutch are delayed in the manual feed mode (FIG. 9B) as compared with the cassette feed mode (FIG. 9A). In FIG. 9C, the timing of the primary charge operation and the transfer corona charge operation is delayed as compared with those of FIG. 9B, in order to correct the operation period thereof, which is preferable.

Figure 10A:
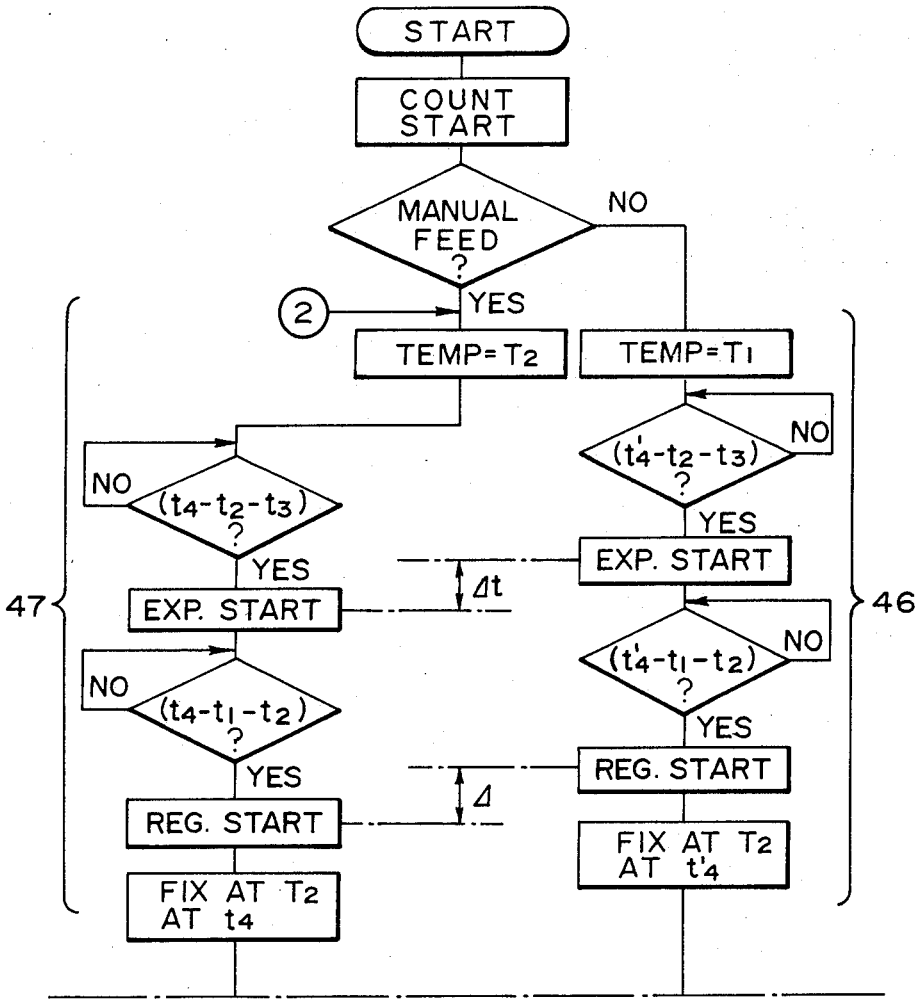
FIGS. 10, 10A and 10B are flow charts in the apparatus according to the embodiment of the present invention.
Figures 10, 10A, 10B:
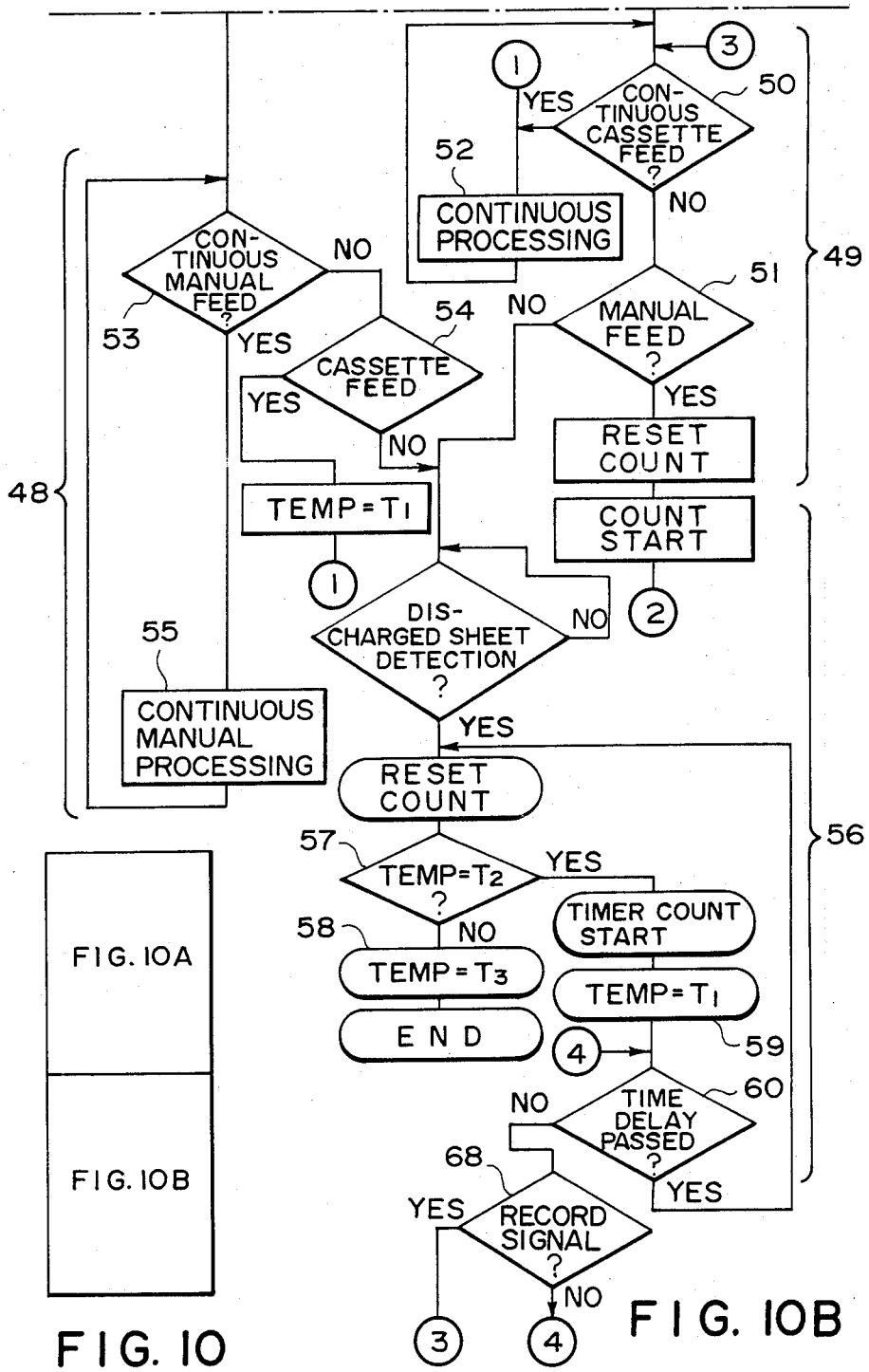

FIG. 10 is a flow chart for the control of the system on the basis of the described temperature conditions, including timing control and the automatic temperature reset.

In the flow chart of FIG. 10, the flow 46 is made on the basis of the following. The time t1 (second) is the time required for the recording material 17 to be transported from the registration roller 22 to the transfer charger position B ; t2 (second), the time required for the recording material 17 to be transported from the position B to between the fixing roller 1 and the pressure roller 2; t4' (second), the time required for the surface temperature of the fixing roller 1 to rise from the stand-by temperature T3 to the cassette feed mode temperature T1 (>T3); and t4 (second), the time required for the surface temperature to rise from the temperature T3 to the manual feed mode temperature T2 (>T1). The set temperature T2 is higher than the temperature T1, therefore, t4>t4' when no auxiliary heater is used.

Upon the actuation of the print start signal, the recording material 17 is fed in the selected mode. When the recording material 17 reaches the registration roller 22, the control timer starts its counting operation, and simultaneously the discrimination is made as to whether it is in the cassette feed mode or the manual feed mode.

If it is cassette feed mode, the set temperature is increased from T3 to T1. During this temperature rise, the image exposure is prohibited for the time period (t'4 - t2 - t3), and in order to harmonize the recording paper to this, the actuation of the registration roller 22 is delayed by the time period (t'4 - t1 - t2). Due to these controls, when the initial recording material fed in the cassette feed mode reaches the fixing roller 1, the surface temperature thereof has already reached the temperature T2. Accordingly, the satisfactory image fixing action can be performed to the initial recording material. It is added that the controls are not necessary if the stand-by temperature is equal to the cassette feed mode temperature. For the manual feed mode, the recording material is placed toward the manual feed mode detecting sensor 21 so as to place the system into the manual feed mode operation. The time period from this to the recording material reaching the fixing device is determined so that when the recording material reaches the fixing device, the surface temperature of the fixing roller 1 simultaneously reaches or has already reached the temperature T2 approximately. The conditions of the recording material feed is so determined.

Similarly to the described above, the manual feed mode is discriminated after the start of the counting. Then, the set temperature is increased from T3 to T2. During the temperature rise, the image exposure is prohibited for the time period (t4 - t2 - t3), and in order to bring the recording material into registration with the image formed on the photosensitive drum 9, the actuation of the registration 22 is delayed by the time period (t4 - t1 - t2). Due to those controls, when the initial recording material fed in the manual feed mode reaches to the fixing roller 1 to be fixed thereby, the surface temperature of the fixing roller 1 has already reached the temperature T1, so that even the initial recording material is satisfactorily fixed. For the manual feed mode, the temperature is so determined that the fixing device is able to deal with a wide range of recording materials. Still, in order to prevent the unnecessary temperature rise in the apparatus, the image fixing temperatures for the different feeding modes are provided so as to cover those recording materials.

In FIG. 10, the cassette feed flow 46 and the manual feed flow 47 are indicated with the common time axis (not shown) so that the relative time deviation therebetween will be understood. The start of the image exposure and the actuation of the registration roller 22 are delayed by the time period Δt second in the manual feed mode.

FIG. 10 further shows the flows 48, 49 for the continuous recording operation. The description will be made with respect to those.

During the process of the image fixing in the cassette feed mode or thereafter, a discrimination is made as to whether the continuous recording material feed is being or is to be effected in the same mode, that is, the cassette feed mode, at step 50. If so, the continuous cassette feed operation 52 is effected. This operation 52 is different from that shown in the flow 46 in the recording material feeding operation and the recording operation. More specifically, since the image fixing device has been reached to the temperature suitable for the cassette feed mode, the image exposure and the actuation of the registration roller 22 are effected without delay. If there is a further continuous cassette mode feed, the operation 52 is repeated. If there is no continuous cassette recording material feed at step 50, a discrimination is made as to whether there is a manual mode recording material feed. If not, the counter is reset in response to the detection of the recording material by the discharged paper detection means 45. Then, the step goes to a step 57. If there is a recording material in the manual feed mode, the mode is changed as shown by 2 .Then, the operation is effected in accordance with the flow 47 under the manual feed mode conditions, or, based on the same technical idea, the time t4 in the flow 47 is replaced with the time t4" which is the time required for the temperture rise for the difference between the cassette feed mode temperature T2 and the manual feed mode temperature T1. This replacement increases the processing speed.

Due to the recording material feed control on the basis of the time t4 or t4", the initial recording material fed manually is satisfactorily processed without unsatisfactory image fixing. Thereafter, a discrimination is made as to whether there is a contrinued manual feed or not. If so, the image exposure and the actuation of the registration roller 21 are effected without delay since the fixing roller 1 has already reached to the temperature suitble for the manual feed mode so that it is not necessary to take the time t4 or t4" into account. This continuous processing is shown at step 55. If there is no continued manual feed mode at step 53, a discrimination is made further as to whether there is the recording material feed in the other feed mode, that is, the cassette feed mode, at step 54. If so, the temperature setting is changed to T1, and instantaneously the processing is performed in accordance with the cassette feed mode continuous processing, described above. This is because the surface temperature of the fixing roller 1 is higher than the temperature T1. If there is no cassette feed mode recording material at the step 54, the counter is reset after the detection by the discharged paper detecting means 45, and then the sequence goes to step 57.

In the foregoing embodiment, the apparatus includes the temperature setting means for setting, for the sake of the second paper feed mode, the higher temperature than in the first feeding mode which is more usually selected, so as to cause the apparatus to meet a variety of recording materials without degrading the image fixing quality; and further includes the recording material feeding means for feeding the recording material in the second recording material feed mode in the manner that the temperature difference can be compensated. Accordingly, the embodiment is applicable to a small size apparatus or an apparatus having a shorter feeding passage without degrading the image fixing quality and with a high durability and reduced temperature rise in the apparatus.

Additionally, in this embodiment, the recording material feeding operaiton is made different between for the initial recording material and for the successive recording materials in a feeding mode, so that the continuous recording materials are processed at higher speed with good advantages. Particularly, feeding the successive recording materials substantially more rapidly than the initial recording material to the heat fixing device, is effective to further prevent the temperature rise in the apparatus and the heat deterioration of the rollers, the photosensitive member and the like with the increased recording speed.

Figure 11:
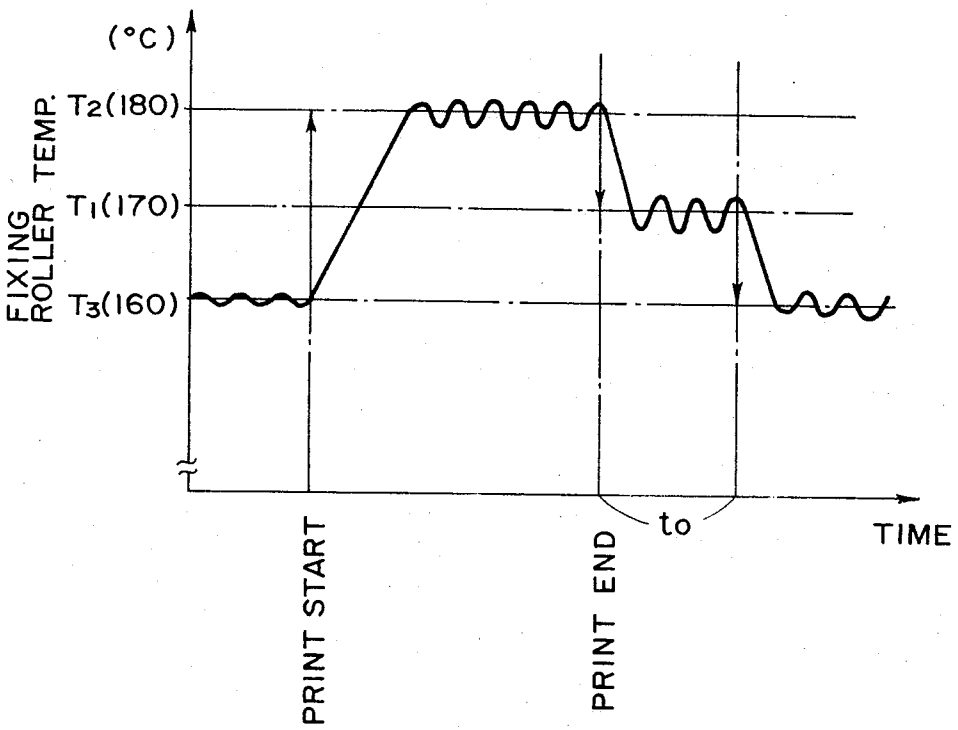
FIG. 11 illustrates the temperature change in an apparatus according to an embodiment of the present invention.

The flow chart of FIG. 10 includes a flow 56 which contains one of the important features of this embodiment. The fact that the detecting means 45 detects a recording material means the completion of the continuous image fixing or a single image fixing operation. Therefore, as described hereinbefore, the system may be restored to the stand-by state T3. In this embodiment, however, the system is not so controlled when the system is set to the higher image fixing power, that is, the manual feed mode in this embodiment. This is shown in FIG. 11. Upon the termination of the higher image fixing power mode operation, for example, the manual feed operation, the temperature setting is decreased by plural steps so as to quickly respond to the recording instructions without substantial time delay from the termination of the operation.

This will be described in more detail. At step 57, the discrimination is made as to whether the current temperature setting is T2 or not. If it is T1, that is the cassette feed mode temperature, the temperature setting is changed to the stand-by temperature T3 at step 58 so as to prevent the temperature rise. However, if the current temperature is T2, the timer restart its counting operation, and simultaneously, the temperature setting is reduced only to the cassette feed mode temperature T1, not to the stand-by temperature T3. This is intended in order to effect a high speed recording is response to the recording instructions which will be made at the interval, during which interval the next printing instructions are given with higher possibility. The temperature T1 is kept for the predetermined time period t0. In view of the influence by the heat, the time period t0 is preferably several minutes, more preferably 1–2 minutes.

During the time period t0, a discrimination is made as to where the next recording instruction signal is given or not, at step 68. If so, the apparatus is operated by the sequence shown by ③ , so that the recording material feed control is carried out so as to be suitable for the next recording material, in accordance with the discrimitions 50 and 51. The fixing conditions are also controlled in the manner described above.

If there is not next recording signals during this time period t0, the counter is reset, and the temperature is decreased to T3, after the time period t0 has passed, as shown in FIG. 6.

Accordingly, the influence of the heat is minimized, and simultaneously the image fixing quality in the respective modes are improved, so that the present inention is practically very effective.

In this embodiment, the cassette feed mode temperature T1 is lower by as large as 10° C. than in the conventional apparatus, the temperature rise prevention and the roller deterioration prevention are provided, and in addition, the possible curling of the recording material can be prevented, which otherwise may be caused by overheating the recording materials fed from the cassette. Thus, appropriate image fixing operation is assured.

As another example, when the temperature is switched in response to the detection of the manual feed mode or to the start of the cassette feed mode recording operation, the temperature setting may be kept for a predetermined period of time, e.g. 1–2 minutes after the termination of the recording operation in that mode. Keeping the high temperature for 1–2 minutes does not result in serious damage or deterioration to the rollers, but it is minimum. During the 1–2 minutes period, the possibility is high as to the next printing operation being instructed. Therefore, the continued temperature keeping is advantageous for the user, since it can reduce the waiting time. In FIG. 11, the temperature is temporarily decreased to the cassette feed temperature after the termination of the manual feed mode operation. However, it is a possible alternative that the temperature is lowered to the value which is lowere than the manual feed mode temperature with the similar result.

In the foregoing embodiments, the change of the image fixing power, such as the temperature, is effected in response to the output of detecting means, but this may be carried out on the basis of the time. For example, the recording materials fed from the cassette or manually fed are measured in their sizes (length). Then, the time is determined, which is required for the paper of that size to be discharged from the fixing roller 1 from the start of the printing. A timer is actuated in response to the print start. The temperature setting for the fixing roller 1 is restored to the stand-by temperature when the timer indicates that the time period determined in accordance with the size of the recording material in the manner described above has passed. Alternatively, the timing for restoring the temperature setting from T2 to T3, or from T1 to T3 on the basis of the length of the high level of the manual feed mode sensor or the image exposure signal.

In the foregoing embodiments, the detection of the manual feed mode is carried out by the sensor provided at the inlet of the recording material, and the temperature is changed in response to the sensor. However, it is a possible alternative that the apparatus is provided with a manually operable switch for switching the operation mode to the manual feed mode, wherein the switch may be disposed on the operation panel or adjacent to the manual feed inlet, the temperature being switched to the manual feed temperature T2 in response to the actuation of this switch. Furthermore, the foregoing embodiments have been described as having the cassette feed mode, but in a copying apparatus, for example, wherein the manual feed can be made by a cassette for the manual feed using a manual feed supply passage, the apparatus is such that the user selects the mode by a mode selection switch. In this case, the temperature of the fixing device is increased when the manual feed cassette is selected than when the usual cassette feed mode is selected.

If the apparatus is such that two types of cassettes are usable, or if two different recording material passages are usable, the types of the recording materials for the respective cassettes are predetermined, and the surface temperature of the fixing roller 1 is changed in response to the detection of the modes or in response to the output of the sensor provided for the respective passages.

However, it is practically preferable to change the fixing conditions depending on the manual feed mode and the cassette feed mode, since the erroneoous operation is much less frequent and because of the longer durability with much simplified structures.

Figure 12:
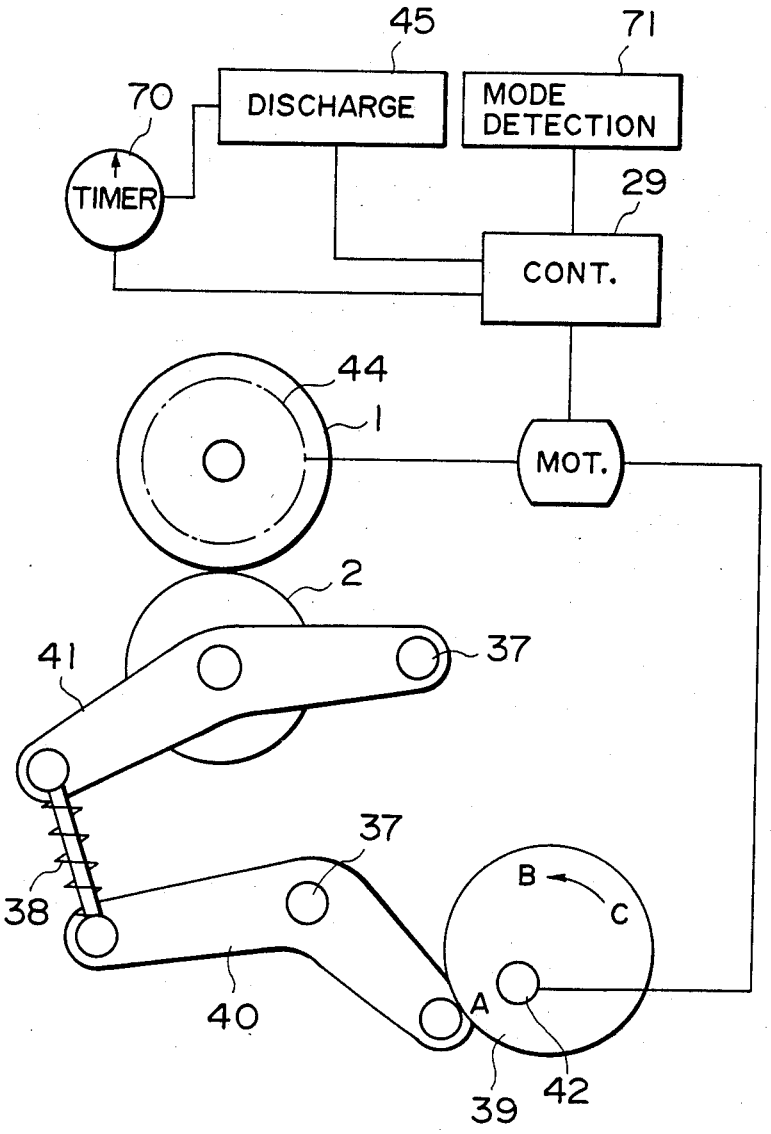
FIG. 12 illustrates a mechanism for variable pressure and driving, used with the apparatus according to the present invention.

The foregoing embodiemnts have been described as changing the temperature of the fixing device, but one or more other fixing conditions may be solely or additionally changed. For example, as shown in FIG. 12, the pressure between the fixing roller 1 and the pressure roller 2 or the transporting speed of the recording material through the fixing device (the speed of the image fixing process) may be solely changed or changed together with the other fixing condition. This is particularly advantageous in the case where it is necessary to employ the temperature difference over 20° C., and where the waiting time, in use of the apparatus, is long. This is because the temperature difference can be reduced. Description will be made in conjunction with FIG. 12.

Referring to FIG. 12, when a feed mode detector 71 detects a feed mode, that is, the manual feed mode or cassette feed mode, in this embodiment, control means 69 causes a driving motor M to rotate the fixing roller in accordance with the feed mode, and simultaneously the pressure between the rollers 1 and 2 is controlled in accordance with the feed mode. A timer 70 starts in response to the output signal from the discharged paper detecting means 45 and delays, by the amount of time period t0, the timing of lowering by the control means 69 the fixing power (lowering the fixing pressure or increasing the fixing speed). This is performed in the similar manner described with the flow 56 of FIG. 10.

In FIG. 12, the fixing device includes the fixing roller 1 having a fixedly secured axis, the pressure roller 2 rotatably mounted on an arm 41. The arm 41 is fixed adjacent to one end thereof by a fixing pin 37, and the other end thereof is engaged with a compression spring 38. The other end of the compression spring is engaged with another arm 40 which is pivotable about a fixed pin 37. The arm 40 has an end contacted to a cam surface of an eccentric cam member 39 which is rotatable about a pin 42. During the stand-by state, the eccentric cam 39 contacts the arm 40 at a point A thereof. In this state, there is no pressure contact between the fixing roller 1 and the pressure roller 2.

When the print switch is depressed with the cassette feed mode, the eccentric cam 39 starts to rotate in the direction of the arrow until it contacts the arm 40 at its cam surface portion B, and stops there. Then, the compression spring 38 pivots the arm 40 to further compress the spring 38. This pivots the arm 41 in the clockwise direction about the fixed pin 37, and therefore, the pressure roller 2 is pressed to the fixing roller 1 at a certain pressure P1.

When in the manual feed mode, the manual feed mode sensor 21 detects the recording material, whereupon the eccentric cam member 39 rotates in the direction of arrow until the cam surface contacts the arm 40 at the point C, and stops there. In this state, the fixing roller 1 and the pressure roller 2 is pressed under the pressure P2 (>P1).

After completion of the printing operation, the contact point of the cam 39 is restored to the point A, with the result that the pressure between the rollers 1 and 2 is released. As described, the pressure between the fixing roller 1 and the pressure roller 1 is increased in the manual feed mode, so that it can meet a thick sheet of paper or OHP paper which requires higher fixing power. The time required for the pressure change is not more than 0.5 second, which eliminates the necessity of changing the image forming sequences depending on the mode selected. This is effective to make the control circuit simpler to reduce the cost of the apparatus.

In this embodiment, the lower pressure is employed for the cassette feed mode which is more frequently used, while the higher pressure is employed for the manual feed mode, whereby the durability is increased, that is, the service life of the rollers, for example, is increased. Additionally, the pressure therebetween is released during the stand-by state, resulting in less deformation of the rubber material of the roller. This is effective to avoid the occurrence of wrinkle of the recording material. Furthermore, this is also effective to make the service life longer. Therefore, this embodiment is preferable in the pressure control, independently of the mode change.

In addition, the transporting speed in the fixing device is additionally controlled so as to decrease the speed when in the manual feed mode. More particularly, when a thick sheet is manually fed, the driving means for the fixing rotatable member, such as a roller, is exchanged to decrease the transporting speed of the fixing roller or belt, thereby increasing the time period of the heating and/or the pressing to the recording material to increase the fixing power.

In the cassette feed mode, the fixing roller 1 and the pressure roller 2 are rotated at the peripheral speed V1 (the speed V1 is equal to or slightly lower than the peripheral speed of the photosensitive drum 9). Upon the termination of the printing operation, the main motor 34 stops to cause the fixing roller 1 and the pressure roller 2 to stop.

When, on the other hand, the operator manually feeds the recording material, the manual feed mode detecting sensor 21 is actuated to detect the manual feed mode so as to switch the controller to the manual feed mode. In response to a signal produced by the controller, the peripheral speed of the fixing roller 1 and the pressure roller 2 is changed to V2 which is smaller than the speed V1 in the cassette feed mode.

As described, in this embodiment, the transporting speed in the fixing device is decreased when the manual feed mode is selected, so that the recording material is heated for a longer time, whereby the toner image fixing to the thick sheet is improved.

According to this manner, the fixing temperature is not needed to increase much to completely fuse the toner image. Therefore, the contamination to the sheet or the roller with off-set toner is prevented which often takes place when thick sheets are used in the conventional apparatus.

Description has been made mainly for the cases where the temperature setting, the number of energized heaters, the pressure and the fixing speed are solely controlled, but this is not limiting, and a plurality of them may be combined. Particularly, however, it is practically preferable with good advantages to include the change of the temperature setting.

In the embodiment described hereinbefore, the temperature is changed to one of T1=170° C., T2=180° C. and T3=160° C. with the line pressure P1=0.25 kg/cm maintained constant. If however, for example, the temperature change is combined with the pressure change in such a manner that the combination between the pressure of P1=0.24 kg/cm, P2=0.25 kg/cm and P3=0 kg/cm and the temperature of T1=170° C., T2=175° C. and T3=160° C., respectively, the same results is obtained with the less change of the temperature. This is advantageous, particularly when the electric power usable for the heater is not great enough or when the tolerable pressure change is not great enough because of the strength of the core and the roller rubber thickness. Besides this combination, the combination of the transporting speed, the pressure change and the temperature change is possible.

According to the present invention, the fixing conditions and/or the recording material feeding conditions are switched in response to the recording material feed mode, and therefore, the fixing operation can be performed in a stable and ensured manner, and the various parts in the apparatus are made durable. Particularly, by changing the fixing temperature, it is made possible to lower the fixing temperature for the usual paper which is relatively easy to fix the toner image and which is relatively frequently used. Due to this temperature decrease, the fixing roller of the fixing device, particularly the one provided with rubber, can have longer life. This advantage is further increased when the temperature change is combined with the pressure change. The further improvement is made by lowering the temperature in the stand-by state than the temperature during the fixing operation being carried out. This is also effective to save the energy consumption during the stand-by state and in the cassette mode and also to reduce the temperature rise in the apparatus. Also, in the present invention, the first and second fixing conditions responsive to the first and second recording material feed modes, respectively, are so determined that the second fixing condition provides higher fixing power; and after completion of the second mode operation, the fixing conditions therefor is not maintained, but the fixing power is lowered, so that the temperature rise in the apparatus is minimized to prolong the life of the parts therein. As a result, economical and durable apparatus can be provided.

Particularly, the present invention is conveniently applicable to such printers as being kept always under the conditions necessary and sufficient for the recording operation as in printer suitable for many office automation devices.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus comprising:

a couple of rollers for fixing an image to be recorded on a recording material selectively under a first fixing condition or a second fixing condition;

means defining first and second recording material inlets, wherein the first recording material inlet and the second material inlet are located at different positions;

means for feeding the recording material between said couple of rollers selectively in a first recording material feed mode or a second recording material feed mode wherein the recording material is fed from said first inlet in the first recording material feed mode and from said second inlet in the second recording material feed mode;

means, responsive to the change of the recording material feed modes, for bringing said couple of rollers under the first fixing condition upon selection of the first recording material feeding mode and under a second fixing condition, which is different from the first fixing condition, upon selection of the second recording material feed mode, wherein said mode responsive means includes means for setting a pressure between said couple of rollers, the pressure being higher in the second fixing condition than in the first fixing condition.

2. A recording apparatus comprising:

a couple of rollers for fixing an image to be recorded on a recording material selectively under a first fixing condition or a second fixing condition;

means defining first and second recording material inlets, wherein the first recording material inlet and the second material inlet are located at different positions;

means for feeding the recording material between said couple of rollers selectively in a first recording material feed mode or a second recording material feed mode wherein the recording material is fed from said first inlet in the first recording material feed mode and from said second inlet in the second recording material feed mode;

means, responsive to the change of the recording material feed modes, for bringing said couple of rollers under the first fixing condition upon the first recording material feeding mode and under a second fixing condition, which is different from the first fixing condition, upon the second recording material feed mode, wherein said mode responsive means include means for setting a speed, at which the recording material passes between said couple of rollers, the speed being lower in the second fixing condition than in the first fixing condition.

3. An apparatus according to claim 1 or 2, wherein the recording material is automatically fed in the first recording material feed mode, and the recording material is manually fed from outside of the apparatus in the second recording material feed mode.

4. A recording apparatus comprising:

heat fixing means;

means for forming an image on a recording material;

means defining first and second recording material inlets, wherein first recording material inlet and second recording material inlet are located at different positions;

means for feeding the recording material selectively in a first recording material feed mode or in a second recording material feed mode which is different from the first recording material feed mode, wherein the recording material is fed from said first inlet in the first recording material feed mode and from said second inlet in the second recording material feed mode;

means, responsive to the recording material feed modes, for bringing said fixing means under a first heat-fixing condition upon selection of the first recording material feed mode and bringing said fixing means, upon selection of the second recording material feed mode, under a second heat fixing condition, in which a heating temperature of said fixing means is higher than in the first heat-fixing condition;

means for once stopping the recording material fed from said inlet and refeeding said recording material after a time period from the stopping, which is longer in said second recording material feed mode than in said first recording material feed mode;

wherein said feeding means, when in the first recording material feed mode, feeds the recording material to said fixing means, placed under the first heat-fixing condition, under a first recording material feeding condition corresponding to the first recording material feed mode, and said feeding means, when in the second recording material feed mode, feeds the recording material to said fixing means, placed under the second heat-fixing condition, under a second feeding condition corresponding to the second recording material feed mode.

5. An apparatus according to claim 4, wherein said image forming means includes a photosensitive image bearing member for bearing thereon the image, means for exposing said image bearing member to a light image corresponding to the image to be formed on the image bearing member, and means for delaying start of the image exposure by said exposing means in the second recording material feed mode as compared with the start in the first recording material feed mode.

6. An apparatus according to claim 4, wherein the recording material is automatically fed from a recording material feeding cassette under the first feeding condition, and the recording material is manually fed from outside of said apparatus under the second feeding condition.

7. An apparatus according to claim 4, wherein said apparatus further comprising means for automatically bringing said fixing means under a fixing condition which provides heating temperature lower than that of the second heat-fixing condition, after the recording material, fed in the second recording material feed mode is subjected to the image fixing operation by said fixing means placed under the second heat-fixing condition.

8. An apparatus according to claim 7, wherein, after image fixing operation under said second heat-fixing condition, the heating temperature of said fixing means is changed to the heating temperature for said first heat-fixing condition.

9. An apparatus according to claim 4, wherein said mode responsive means, when said apparatus is in a stand-by state, the heating temperature of said fixing means is changed to a stand-by temperature which is lower than the heating temperature of said first heat-fixing condition.

10. An apparatus according to claim 9, wherein, after image fixing operation under said first heat-fixing condition, the heating temperature of said fixing means is changed from the heating temperature for said first heat-fixing condition to the stand-by temperature for said stand-by condition.

11. An apparatus according to claim 9, wherein after image fixing operation under said second heat-fixing condition, the heating temperature of said fixing means is changed from the heating temperature for said second heat-fixing condition to the stand-by temperature for said stand-by condition.

12. An apparatus according to claim 11, wherein, after image fixing operation under said second heat-fixing condition, the heating temperature of said fixing means is changed from the heating temperature for said second heat-fixing condition to the heating temperature for said first heat-fixing condition, and in turn to the stand-by temperature for said stand-by condition.

13. An apparatus according to claim 12, wherein, after image fixing operation under said second heat-fixing condition, the heating temperature of said fixing means is maintained at the heating temperature for said first heat-fixing condition, during the time period which is shorter one of the time to a generation of fixing instructions asnd a predetermined period of time.

14. An apparatus according to claim 4, wherein said image forming means comprises a member for bearing an image to be transferred onto, and be fixed on, recording material, said image bearing member being rotated prior to image formation thereon, wherein the prior rotation of said image bearing member is longer in said second recording material feed mode than in said first recording material feed mode.

15. An apparatus according to claim 4, further comprising detecting means for detecting the recording material fed in the second recording material feed mode, wherein the fixing condition of said fixing means is switched from the first heat-fixing condition to the second heat-fixing condition upon said detecting means detecting the recording material.

16. An apparatus according to claim 4, wherein said fixing means comprises a couple of rollers press-contacted to each other for gripping and advancing the recording material, and heating means for heating the couple of rollers.

* * * * *

UNITED STATES PATENT AND TRADEMARK OFFICE

CERTIFICATE OF CORRECTION

PATENT NO. : 4,719,489 Sheet 1 of 3

DATED : January 12, 1988

INVENTOR(S) : MASAHARU OHKUBO, ET AL.

It is certified that error appears in the above-identified patent and that said Letters Patent is hereby corrected as shown below:

Column 1, lines 15-16, "placti-cable" should read --practicable--.

Column 4, line 27, "reach to" should read --reaching--;

line 32, "temperture" should read --temperature--.

Column 5, line 2, "material 7" should read --material 17--.

Column 6, line 68, "period," should read --periods,--.

Column 7, line 31, "exists" should read --used--.

Column 8, line 4, "effect" should read --effects--;

line 5, "conrol" should read --control--;

line 54, "heater" should read --heaters--.

Column 9, line 15, "B;" should read -- B ;--;

line 17, "B;" should read -- B ;--.

UNITED STATES PATENT AND TRADEMARK OFFICE

CERTIFICATE OF CORRECTION

PATENT NO. : 4,719,489 Sheet 2 of 3

DATED : January 12, 1988

INVENTOR(S) : MASAHARU OHKUBO, ET AL.

It is certified that error appears in the above-identified patent and that said Letters Patent is hereby corrected as shown below:

Column 10, line 35, "step" (first occurrence) should read --sequence--;

line 37, "2." should read -- 2 .--;

lines 41-42, "temper-ture" should read --temperature--;

line 50, "contrinued" should read --continued--;

line 54, "suitble" should read --suitable--.

Column 11, line 17, "operaiton" should read --operation--;

line 50, "restart" should read --restarts--;

line 54, "is" should read --in--;

lines 66-67, "discri-mitions" should read --discriminations--.

Column 12, lines 7-8, "inen-tion" should read --invention--;

line 34, "lowere" should read --lower--;

lines 50-53, "timing" should read --timing is set--.

UNITED STATES PATENT AND TRADEMARK OFFICE

CERTIFICATE OF CORRECTION

PATENT NO. : 4,719,489 Sheet 3 of 3

DATED : January 12, 1988

INVENTOR(S) : MASAHARU OHKUBO, ET AL.

It is certified that error appears in the above-identified patent and that said Letters Patent is hereby corrected as shown below:

Column 13, line 15, "erroneoous" should read --erroneous--;

line 18, "embodiemnts" should read --embodiments--.

Column 14, line 12, "pressure roller 1" should read --pressure roller 2--.

Column 15, line 17, "is" should read --are--.

Column 18, line 33, "wherein said" should read --wherein in said-- same line, "is shorter" should read --is the shorter--;

line 34, "asnd" should read --and--.

Signed and Sealed this

Twenty-first Day of June, 1988

*Attest:*

*Attesting Officer*

DONALD J. QUIGG

*Commissioner of Patents and Trademarks*